US005826369A

United States Patent [19]

Jordan

[11] Patent Number: 5,826,369

[45] Date of Patent: Oct. 27, 1998

[54] CHLOROPHYLL BASED FUEL ADDITIVE FOR REDUCING POLLUTANT EMISSIONS

[75] Inventor: Frederick L. Jordan, Santa Ana, Calif.

[73] Assignee: Barto/Jordan Company, Inc., Costa Mesa, Calif.

[21] Appl. No.: 717,844

[22] Filed: Sep. 23, 1996

Related U.S. Application Data

[63] Continuation-in-part of Ser. No. 163,651, Dec. 7, 1993, abandoned.

[51] Int. Cl.[6] ..... C10L 1/18; C10L 1/22

[52] U.S. Cl. ..... 44/308; 44/423

[58] Field of Search ..... 44/307, 308, 423

[56] References Cited

U.S. PATENT DOCUMENTS

| | | | |
|---|---|---|---|
| 2,445,778 | 7/1948 | Hale | 44/307 |
| 3,563,714 | 2/1971 | Brewer | 44/573 |
| 3,849,323 | 11/1974 | Hollinshead | 252/56 R |
| 4,274,835 | 6/1981 | Jordan | 44/1 |
| 4,300,009 | 11/1981 | Haag et al. | 585/408 |
| 4,499,267 | 2/1985 | Scifoni | 44/51 |
| 4,678,860 | 7/1987 | Kuester | 585/14 |
| 4,873,008 | 10/1989 | Landis et al. | 252/46.6 |
| 5,152,688 | 10/1992 | Cellini | 434/29 |
| 5,154,844 | 10/1992 | Perozzi | 252/47.5 |
| 5,160,506 | 11/1992 | Schuur et al. | 44/308 |

*Primary Examiner*—Margaret Medley
*Attorney, Agent, or Firm*—Oppenheimer Wolff & Donnelly LLP

[57] ABSTRACT

Beta-carotene, chlorophyll and jojoba oil are used together as a fuel additive to enhance combustion characteristics of carbonaceous fuels. Among the observed beneficial characteristics are reductions in the level of common pollutants emitted during combustion. Ethoxylated castor oil is also used in conjunction with the beta-carotene, chlorophyll and jojoba oil to provide enhanced combustion characteristics and reductions in pollutant emissions.

17 Claims, No Drawings

CHLOROPHYLL BASED FUEL ADDITIVE FOR REDUCING POLLUTANT EMISSIONS

This is a continuation-in-part of U.S. patent application Ser. No. 08/163,651, which was filed on Dec. 7, 1993 and is now abandoned.

BACKGROUND OF THE INVENTION

1. Field of the Invention

The present invention relates generally to reducing the amounts of pollutants produced during the combustion of carbonaceous fuels such as gasoline, diesel fuel, fuel oil, and coal. More particularly, the present invention relates to materials that can be added to the fuel prior to combustion in order to reduce the level of pollutants emitted as a result of the combustion process.

2. Description of Related Art

The combustion of carbonaceous fuels is a major source of air pollution. The primary pollutants produced as a result of the combustion of such fuels include carbon monoxide, nitrogen oxides, sulfur oxides, unburned hydrocarbons, particulate matter, and volatile organic compounds.

There is today considerable interest in developing processes for eliminating or substantially reducing the amounts of pollutants that are emitted into the atmosphere as a result of fuel combustion. One approach involves treating the fuel prior to combustion in order to remove pollutant precursors. For example, numerous desulfurization processes have been devised to remove sulfur from fuel oil, coal, and other fuels prior to combustion. Although it is desirable to use preprocessed fuels that are inherently clean-burning, such fuels are expensive to produce.

Another approach to reducing air pollution involves treating the combustion gases to remove pollutants. A wide variety of adsorbents, as well as catalytic materials, have successfully been used for the removal of pollutants from combustion gases, including carbon monoxide, nitrogen oxides, and sulfur oxides. For example, catalytic mufflers have been successfully used in automobiles to reduce pollutant emissions. Other scrubber devices have also been employed with some success in the removal of pollutants from a variety of combustion flue gases.

In addition to the above pollution-control mechanisms, there has also been interest in developing fuel additives that can be mixed with the fuel prior to combustion. The fuel additive participates in the combustion process, and its components act as scavengers or otherwise react with pollutants to convert them into nonpolluting combustion products. An example of this type of fuel additive is disclosed in U.S. Pat. No. 4,274,835; and involves improving combustion efficiency and reducing sulfur combustion emissions from burning coal by the addition of small amounts of chlorophyll, squalane, squalene, carotenoids, or mixtures thereof.

Many other processes have been developed over the years that are also effective in controlling pollutant emissions. However, the importance of reducing the amounts of substances emitted into the air mandates that researchers continue to seek new and improved methods for limiting the pollutants produced as a result of the combustion of carbonaceous fuels.

SUMMARY OF THE INVENTION

The present invention provides a method for reducing the levels of carbon monoxide and oxides of nitrogen and sulfur that are produced during the combustion of carbonaceous fuels, including, but not limited to, natural gas, gasoline, no. 1 diesel fuel, and no. 2 diesel fuel; and higher residual fuels including, but not limited to, No. 4 fuel oil, no. 5 light and no. 5 heavy fuel oils, and No. 6 fuel oil (Bunker C). The invention is based upon the discovery that adding synthetic trans β-carotene in combination with jojoba oil and chlorophyll in a suitable solvent to the fuel prior to combustion results in the reduction of pollutant emissions that would otherwise occur.

As a feature of the present invention, polyethoxylated castor oil surfactants may also be included in the fuel additive to provide additional component solubilization. Moreover, the addition of alkyl nitrates (e.g., 2-ethylhexyl, mixed octyl, etc.) to the synthetic trans β-carotene/jojoba/chlorophyll mixture reduces pollutant emissions resulting from the combustion of no. 2 diesel fuels as well as higher residual fuels, including, but not limited to, no. 4 fuel oil, no. 5 light and no. 5 heavy fuel oils, and no. 6 fuel oil (Bunker C) by acting synergistically with the synthetic trans β-carotene/jojoba/chlorophyll mixture to elevate cetane number.

The present invention is applicable to the full range of combustible carbonaceous fuels, including, but not limited to, natural gas, gasoline, no. 1 diesel fuel, and no. 2 diesel fuel; as well as higher residual fuels including, but not limited to, no. 4 fuel oil, no. 5 light and no. 5 heavy fuel oils, no. 6 fuel oil (Bunker C), and coal. Thus, the fuel additive of the present invention is suitable for use in a wide variety of combustion processes wherein emission of pollutants such as carbon monoxide, nitrogen oxides, sulfur oxides, unburned hydrocarbons, particulate matter, and volatile organic compounds are a problem. The method is advantageous in addition in that it obviates the need for other pollution reduction strategies such as treatment of exhaust gases. Moreover, the fuel additive of the present invention has been found to increase the combustion efficiency and power output of a variety of fuels including, but not limited to, natural gas, gasoline, no. 1 diesel fuel, no. 2 diesel fuel; as well as higher residual fuels including, but not limited to, no. 4 fuel oil, no. 5 light and no. 5 heavy fuel oils, and no. 6 fuel oil (Bunker C).

The exact mechanisms by which the synthetic trans β-carotene/jojoba/chlorophyll mixture interacts with pollutants during combustion to lower emission levels is not understood. However, it is believed that the fuel additives give rise to an increase in dissolved oxygen and water in the fuel itself, which results in turn in reduction of pollutant emissions. The mechanism(s) by which polyethoxylated castor oil surfactants and alkyl nitrate cetane boosters facilitate the reduction of emissions in diesel and higher residual fuels is not understood.

The above-described and many other features and attendant advantages of the present invention will become better understood by reference to the following detailed description.

DETAILED DESCRIPTION OF THE INVENTION

The fuel additive of the present invention in its basic form is composed of a concentrated solution of synthetic trans β-carotene admixed with jojoba oil and chlorophyll. The concentrated additive solution may be diluted with a suitable solvent, if desired. Suitable diluent solvents include various organic liquids such as gasoline, no. 1 diesel fuel, no. 2 diesel fuel, xylene, toluene, cyclic hydrocarbons, hydrocarbon liquids containing cyclic constituents, liquid hydrocarbon fuels, halogenated hydrocarbon solvents (e.g., chloroform, trichloroethylene, etc.), liquid aldehydes, alcohols, and ketones, and even small amounts of water. Any organic solvent may in fact be used provided that it does not adversely increase pollutant emission levels. If desired, cetane boosters (alkyl nitrates: e.g., 2-ethylhexyl nitrate, mixed octyl nitrates, etc.; 0.01–99% v/v) may also be added at this time, depending upon the fuel to be treated). The preferred level of alkyl nitrate cetane booster is from 0.05 to 5% v/v. Also, if desired, the various ingredients used to make up the fuel additive may be added separately to the fuel.

The relative amounts of synthetic trans β-carotene, chlorophyll and jojoba oil may be varied depending upon the particular fuel being treated and the particular combustion conditions. In general, the ratio of synthetic trans β-carotene to jojoba oil may be varied from 8:100 to 20:100 w/v. The ratio of chlorophyll to jojoba oil may be varied from 1:100 to 50:100 w/v. The ratio of chlorophyll to synthetic trans β-carotene may be varied from 1:20 to 5:1 w/w.

For diesel and gasoline fuels being combusted in appropriate engines at conventional temperatures and pressures, the amount of total additive used to treat the fuel is generally less than 10% v/v. Typical optimal additive levels for treating fuel range from about 0.1 to 3% v/v.

For diesel fuel combusted in a diesel engine at conventional temperatures and pressures in accordance with the present invention, the fuel additive may also include 20 to 60% v/v polyethoxylated castor oil surfactants in addition to the synthetic trans β-carotene/jojoba oil/chlorophyll. The amount of polyethoxylated castor oil in the fuel additive can range from 0 to 75% v/v depending on the particular fuel and combustion conditions. The amount of total fuel additive for diesel fuel should nevertheless still be kept below 10% v/v. Preferred additive levels for diesel fuel when polyethoxylated castor oil is included in the additive mixture are about 0.2 to 1.5% v/v. The amount of polyethoxylated castor oil in the fuel in general should range from 0.05 to 3% v/v.

The particular ratios of synthetic trans β-carotene, chlorophyll and jojoba oil for a given fuel additive and the amount of additive that should be added to the fuel in order to obtain optimum emission reductions may be determined by routine experimentation. The procedure involves treating the selected fuel with a series of synthetic trans β-carotene/jojoba oil/chlorophyll combinations at different additive levels to establish which amounts provide the optimal combination of combustion efficiency and emissions reduction.

Depending upon the type of fuel being treated, i.e., solid or liquid, the fuel additive may also be diluted in a solvent prior to application to form an additive concentrate. For example, when the fuel additive is applied to solid particulate fuels (e.g. coal), it is desirable to dissolve the synthetic trans β-carotene/jojoba oil/chlorophyll in a suitable solvent to facilitate spraying or other application of the additive onto the particulate material. In these instances, the amount of solvent carrier used in the fuel additive may range from as little as 0.1% up to approximately 99% v/v. When the additive is combined with liquid fuels, a solvent carrier is usually not required. The amount of synthetic trans β-carotene/jojoba oil/chlorophyll in the additive concentrate is preferably between 0.05% to 10% w/w. As previously mentioned, suitable diluent solvents include various organic liquids such as xylene, toluene, cyclic hydrocarbons, hydrocarbon liquids containing cyclic constituents, liquid hydrocarbon fuels, halogenated hydrocarbon solvents (e.g., chloroform, trichloroethylene, etc.), liquid aldehydes, alcohols, and ketones, and even small amounts of water. Any organic solvent may in fact be used provided that it does not adversely increase pollutant emission levels.

The jojoba oil, synthetic trans β-carotene, chlorophyll, polyethoxylated castor oil surfactants, and alkyl nitrate cetane boosters used in preparing the fuel additive can be obtained commercially from a wide variety of sources. Jojoba oil, synthetic trans β-carotene, chlorophyll, polyethoxylated castor oil surfactants, and alkyl nitrate cetane boosters are all well-known compounds that have been commercially available from numerous sources for many years. For example, synthetic trans β-carotene is available from BASF Corp., Parsippamy, N.Y. Synthetic trans β-carotene is preferred over trans β-carotene that has been extracted from plant or animal material.

The temperature and pressure at which combustion takes place affects the level of pollutants emitted during a particular combustion process. The effectiveness of the fuel additive in the present invention will also vary depending upon combustion conditions, for example, the fuel to oxygen ratio. As a routine matter of experimentation, one skilled in the art can determine what fuel additive level provides optimum pollutant emission reduction for a given fuel when burned under certain combustion conditions. Further, as mentioned previously, the amount of synthetic trans β-carotene, chlorophyll, jojoba oil, polyethoxylated castor oil, and alkyl nitrates, if any, included in the fuel additive can also be determined by routine experimentation to achieve optimum pollutant emission reduction.

The following typical examples are limited to exemplary embodiments involving reduction in pollutant emissions and increased fuel efficiency for liquid fuels such as diesel fuel and gasoline. It will be understood by those skilled in the art that the fuel additives in accordance with the present invention may also be used effectively to reduce pollutant emission levels in other combustible carbonaceous fuels mentioned earlier, as well as other combustible fuels, such as hydrogen.

Examples of practice are as follows:

EXAMPLES

Example 1—Demonstration of Emission Reduction during Combustion of No. 2 Diesel Fuel The following example demonstrates the use of the fuel additive in accordance with the present invention to reduce emissions of pollutants during combustion of no. 2 diesel fuel in a diesel engine.

The diesel engine used for this example was a two-cycle, two-cylinder 33-horsepower Detroit diesel engine, model no. 253. The engine was coupled to an M&W dynamometer, model no. P-400B. The fuel used for this example was a no. 2 diesel that was supplied by Paramount Petroleum (Costa Mesa, Calif.). The fuel specifications for the no. 2 diesel are provided in Table 1.

TABLE 1

Specifications for Paramount No. 2 Diesel Fuel

| Parameter | Value |
|---|---|
| Gravity, API @ 60° F. | 32.2 |
| Appearance | 4B |
| Color, ASTM | 1.5 |

TABLE 1-continued

Specifications for Paramount No. 2 Diesel Fuel

| Parameter | Value |
|---|---|
| Corrosion, 3 hr @ 212° F. | 1-A |
| Flash Point, PMMC, °F. | 174 |
| Cloud Point, °F. | 18 |
| Pour Point, °F. | 0 |
| Viscosity, SUS, @ 100° F. | 38.8 |
| Water & Sediment, % v/v | 0 |
| Acid Number, mg KOH/g | 0.003 |
| Mercaptan Sulfur, ppm RSH | 3 |
| Ash, % w/w | 0.001 |
| Carbon Residue, 10% res, % w/w | 0.14 |
| Cetane Index | 47 |
| Sulfur, ppm | 474 |
| Distillation, D-86, °F. | |
| Initial | 341 |
| 10% | 429 |
| 90% | 632 |
| End Point | 698 |
| Recovery, % | 98.0 |
| Saturates, % v/v | 54 |
| Olefins, % v/v | 2.6 |
| Aromatics, % v/v | 43.4 |

A typical fuel additive was prepared as follows. Four grams of synthetic trans β-carotene was dissolved in 100 mL of toluene with warming. The solution was then blended with approximately 1800 mL of no. 2 diesel fuel with constant stirring. Forty-eight milliliters of jojoba oil was added to the mixture with constant stirring. In a separate container, 20 g of chlorophyll was dissolved in 100 mL of no. 2 diesel fuel. Thirty milliliters of this solution was then added to the synthetic trans β-carotene/jojoba oil mixture. The synthetic trans β-carotene/jojoba/chlorophyll mixture was then diluted to 3785 mL with no. 2 diesel fuel. Eight to 100 mL of this concentrated solution was added to every gallon of fuel to be treated.

Neat diesel fuel and fuels containing various amounts of additive were kept in separate large-capacity reservoirs to ensure that negligible fuel temperature changes occurred during any given test run. All fuel weighings were taken by placing a fuel reservoir on the platform of a precision balanced-beam scale. The various formulations are listed in the tables. The amounts of concentrated additive solution in the fuels tested were identified by codes which are identified below:

E=8 ml concentrate per gallon of fuel; B-1=16 ml concentrate per gallon of fuel; B-2=8 ml concentrate per gallon of fuel and 1 ml ethoxylated castor oil per gallon of fuel; A=8 ml concentrate per gallon of fuel; D=8 ml per gallon of fuel—the no. 2 diesel fuel carrier used in the concentrate was aromatic free; EM-1=8 concentrate per gallon of fuel; EM-2=16 ml of concentrate per gallon of fuel; EM-3=24 ml of concentrate per gallon of fuel; and EM-4=32 ml of concentrate per gallon of fuel. A "+" sign after the formula designation means that 2 ml per gallon of mixed alkyl nitrates was also added.

Prior to every run, the engine oil level, radiator level, and dynamometer hydraulic oil were checked. The engine was then started, and allowed to idle for several minutes until the engine water temperature reached 150° F. At this point, the engine speed and dynamometer load were slowly increased to a predetermined maximum horsepower engine output, and allowed to stabilize. The temperature (hence, viscosity) of the dynamometer hydraulic oil was carefully controlled at 140° F. by adjusting the cooling water flow rate. Once the engine water temperature reached 170° F. and the dynamometer hydraulic oil was stable at 140° F., the dynamometer was set to 400 psi and the engine rpm set and locked at 1725. According to the M&W dynamometer calculator, these values defined an engine loading of 33 hp. Prior to the acquisition of any data, approximately 15 minutes full-load run time was permitted to make fine-tuning adjustments to both the engine and dynamometer so as to ensure that the preselected hp loading remained constant.

At the start of each run, the following parameters were recorded: all ambient conditions, all engine and dynamometer conditions, the time, and the fuel weight. Then, throughout the run, the following data were taken: the pounds of fuel burned, the engine rpm and hp, the dynamometer hydraulic temperature, ambient temperature, the exhaust gas temperature immediately after combustion as well as at the end of the exhaust system, the barometric pressure, and the percent relative humidity. The data were taken every 15 minutes; the run time was 2 hours.

Emissions were monitored with two models of portable combustion analyzer, viz., an Enerac 2000 and a Quintox KM. In doing so, several additional procedures were incorporated into the test protocol. First, the combustion analyzer to be employed was precalibrated to manufacturer's specifications. A ridged mounting fixture was then attached to the end of the exhaust stack to receive the monitor probe. The position of this fixture was located in accordance with the manufacturer's recommendation, and was not altered during a test run. Prior to prompting an analyzer to print emission data, it was necessary for its self-monitoring circuitry to indicate that valid data could be printed. Once this condition was verified, the following were printed out: oxygen ($O_2$), %; carbon monoxide (CO), ppm; air, %; carbon dioxide ($CO_2$), ppm; nitric oxide (NO), ppm; nitrogen dioxide ($NO_2$), ppm; nitrogen oxides ($NO_x$), ppm; sulfur dioxide ($SO_2$), ppm; the net, exhaust, and ambient temperatures, °F.; and the date and time. Emissions data were recorded at 15-minute intervals. The analyzer probe was removed from the exhaust gas flow between measurements.

Fuel economy for the various fuel mixtures was measured first. The baseline fuel economy data obtained with untreated no. 2 diesel are provided in Table 2. The average specific fuel consumption (sfc) of the no. 2 diesel was 0.441 lb/hp-hr.

TABLE 2

Series of Runs to Establish a Baseline for Efficiency of Paramount No. 2 Diesel Fuel

| Ave. Barometric Pressure, In Hg | Ave. Rel. Humidity, % | Ave. Ambient Temperature, °F. | Ave. Exhaust Temperature, °F. | Time | Total Fuel Used over 2 hr,lb | SFC, lb/hp-hr |
|---|---|---|---|---|---|---|
| 29.80 | 92 | 66 | 733 | AM | 29.00 | 0.439 |
| 30.71 | 55 | 44 | 724 | AM | 28.75 | 0.436 |
| 30.60 | 55 | 45 | 715 | PM | 28.75 | 0.436 |
| 30.50 | 56 | 44 | 725 | AM | 29.00 | 0.439 |
| 30.38 | 54 | 47 | 734 | PM | 29.25 | 0.443 |
| 30.20 | 74 | 54 | 725 | PM | 28.75 | 0.436 |
| 30.21 | 74 | 53 | 741 | AM | 30.00 | 0.455 |
| Baseline Average Specific Fuel Consumption .441 | | | | | | |

Table 3 shows the comparable data for the same fuel containing additive formulations A through EM-2. The best additive formulation that appeared to provide the greatest increase in fuel efficiency was E, which gave an sfc of 0.356 lb/hp-hr, an improvement of 19% over untreated fuel.

TABLE 3

Series of Runs With Different Formulas of Additive to Establish Efficiency for Paramount No. 2 Diesel

| Ave. Barometric Pressure, In Hg | Ave. Rel. Humidity, % | Ave. Ambient Temperature. °F. | Ave. Exhaust Temperature, °F. | Total Fuel Used over 2hr,lb | SFC, lb/hp-hr | Formula Designation |
|---|---|---|---|---|---|---|
| 30.60 | 61 | 38 | 650 | 26.50 | 0.402 | C |
| 30.46 | 55 | 45 | 681 | 27.00 | 0.409 | B-1 |
| 30.30 | 67 | 51 | 691 | 27.50 | 0.417 | B-2 |
| 30.36 | 78 | 54 | 712 | 27.75 | 0.417 | A |
| 30.31 | 71 | 52 | 650 | 25.25 | 0.383 | D |
| 30.38 | 79 | 50 | 632 | 23.50 | 0.356 | E |
| 30.15 | 80 | 53 | 650 | 24.00 | 0.364 | EM-1 |
| 30.08 | 69 | 59 | 617 | 26.75 | 0.405 | EM-1+ |
| 29.89 | 79 | 70 | 663 | 27.25 | 0.413 | EM-2 |

Next, fuel emissions were determined for various fuel-additive mixtures. The baseline data obtained for untreated no. 2 diesel are given in Table 4.

TABLE 4

Series of Runs to Establish Baseline Emissions Using Paramount No. 2 Diesel

| Analyzer | Ave. CO, ppm | Ave. NOx, ppm | Ave. SO2, ppm |
|---|---|---|---|
| Enerac 2000 | 1260 | 1256 | no measurement possible |
| Enerac 2000 | 1467 | 1326 | no measurement possible |
| Enerac 2000 | 1359 | 1355 | no measurement possible |
| Enerac 2000 | 1283 | 1045 | no measurement possible |
| Enerac 2000 | 1282 | 1203 | no measurement possible |
| AVERAGE | 1330 | 1277 | |
| Quintox KM | 587 | 1524 | 142 |
| Quintox KM | 587 | 1439 | 135 |
| Quintox KM | 552 | 1321 | 172 |
| AVERAGE | 670 | 1428 | 133 |

The results for the fuel containing additives A through EM-2 are then provided in Table 5. Fuel treated with additive B showed a 60% reduction of CO and an 11.1% reduction of $NO_x$ according to the Enerac 2000. Formulation EM-2 gave a 25% reduction of CO and a 4% decrease of $NO_x$, as measured with the Quintox monitor.

TABLE 5

Series of Runs to Establish Reduced Emissions Using Paramount No. 2 Diesel Fuel

| Analyzer | Ave. CO, ppm | Ave. NOx, ppm | Ave. SO2, ppm | Formula Designation |
|---|---|---|---|---|
| Enerac 2000 | 439 | 1239 | no measurement possible | C |
| Enerac 2000 | 496 | 1171 | no measurement possible | B |
| Enerac 2000 | 572 | 1100 | no measurement possible | B |
| Enerac 2000 | 608 | 1137 | no measurement possible | A |
| Quintox KM | 446 | 1496 | 149 | EM-1 |

TABLE 5-continued

Series of Runs to Establish Reduced Emissions Using Paramount No. 2 Diesel Fuel

| Analyzer | Ave. CO, ppm | Ave. NOx, ppm | Ave. SO2, ppm | Formula Designation |
|---|---|---|---|---|
| Quintox KM | 398 | 1473 | 149 | EM-1+ |
| Quintox KM | 506 | 1371 | 108 | EM-2 |

Several concentrations of additive formulation were assessed, as were both hot and cold start engine modes. The concentrations ranged from 0.2 to 4% v/v, based upon total fuel volume.

For specific fuel consumption, the baseline data obtained with untreated no. 2 diesel are shown in Table 6, where the average sfc was 0.455 lb/hp-hr. The data obtained for a series of runs with additives EM-2 through EM-4 are then shown in Table 7. Formulas EM-3+ and EM-4+ each gave a 15.2% decrease in sfc, the overall average for all three runs with treated fuel being a decrease in consumption of 12.3%.

TABLE 6

Run to Establish Baseline SFC for Paramount No. 2 Diesel Fuel

| Ave. Barometric Pressure, In Hg | Ave. Rel. Humidity, % | Ave. Ambient Temperature. °F. | Ave. Exhaust Temperature. °F. | Total Fuel Used over 2 hr,lb | SFC, lb/hp-hr |
|---|---|---|---|---|---|
| 30.10 | 92 | 65 | 675 | 15.0 | 0.455 |

TABLE 7

Series of Runs to Determine SFC of Paramount No. 2 Diesel Fuel with Different Additive Formulas

| Ave. Barometric Pressure, In Hg | Ave. Rel. Humidity, % | Ave. Ambient Temperature. °F. | Ave. Exhaust Temperature. °F. | Total Fuel Used over 1 hr,lb | SFC, lb/hp-hr | Formula Designation |
|---|---|---|---|---|---|---|
| 30.21 | 36 | 58 | 600 | 12.75 | 0.386 | EM-3+ |
| 30.20 | 72 | 65 | 625 | 12.75 | 0.386 | EM-4+ |
| 30.18 | 68 | 68 | 669 | 14.00 | 0.424 | EM-2+ |
| | | | | | Ave. 0.399 | |

The exhaust gases produced by combustion of the various fuels were also analyzed. To accomplish this, a large stack extension was attached to the existing exhaust stack to act as a collection chamber. Engine emissions were run through the stack extension collection chamber, which contained a single sampling point. The exhaust stream was sampled continuously in accordance with EPA Methods 1–5 for particulate matter, which mandates the use of carbotrap tubes. Also, volatile organic compounds (VOCs) were sampled in accordance with EPA Method TO-1/TO-2, then analyzed by gas chromatography/mass spectrometry (GC/MS). In addition, specific fuel consumption was monitored as outlined previously. The results of a comparison of the emissions from the neat fuel with those from fuel containing 2.5% v/v additive are shown in Table 8. In general, the results showed a 25–30% reduction in aromatic VOCs for the treated fuels, with the exception of toluene. It is believed that toluene was formed as a byproduct during additive combustion. Alkane emissions were reduced by nearly 40%. In addition, a 90% reduction in 1,4-dioxane, a highly toxic poison, is significant insofar as this compound is a known byproduct of combustion.

TABLE 8

Example Emission Test Results

| | | Neat Fuel | Treated Fuel | Change, % |
|---|---|---|---|---|
| Particulates, lb/hr | | 0.070 | 0.068 | 3 |
| Particulates, 80/DSCF | | 0.034 | 0.034 | n.c. |
| Moisture, % | | 6.33 | 6.11 | negl. |
| VOCs, mg/m$^3$ (ppb) | | | | |
| Aromatics | Benzene | 370 | 280 | −24 |
| | $C_9$ Alkylbenzenes | 930 | 700 | −25 |
| | Ethylbenzene | 200 | 150 | −25 |
| | Xylenes | 930 | 650 | −30 |
| | Toluene | 340 | 1100 | 324 |
| $C_6$–$C_{10}$ Alkanes | | 7400 | 4600 | −38 |
| 1,4-Dioxane | | 52 | 3 | −94 |

Additional emission data obtained during test runs with the Quintox combustion analyzer for the neat fuel and fuel treated with 2.5% v/v additive are shown in Table 9. The results correspond to those found in previous test runs, thus verifying that the system was functioning identically to that employed in previous testing periods.

TABLE 9

Additional Emission Test Results

| | Neat Fuel | Treated Fuel | Change, % |
|---|---|---|---|
| CO, ppm | 216.00 | 195.75 | −9.4 |
| $NO_x$, ppm | 617.50 | 598.75 | −3.0 |
| $SO_2$, ppm | 45.75 | 32.50 | −29. |

The above examples demonstrate that the fuel additive of the present invention provides a substantial improvement in specific fuel consumption in no. 2 diesel fuel. In addition, appreciable decreases of a broad range of volatile organic compounds were observed. Further, carbon monoxide and, to a lesser extent, nitrogen and sulfur oxides, were also found to be reduced. Thus, the additive favorably impacts the combustion characteristics of no. 2 diesel fuel.

Example 2—Demonstration of Emission Reduction during Combustion of Gasoline

The following example demonstrates the use of the fuel additive in accordance with the present invention to reduce emissions of pollutants during combustion of gasoline in a gasoline engine.

The gasoline engine used for this example was a 1988 Isuzu Trooper II four-cycle, four-cylinder 120-hp 2.559-liter (153.55 cubic inches) engine, model no. 4ZE1, with a compression ratio of 8.3. The fuel used for this example was a commercial unleaded gasoline, octane number 87.

A typical gasoline additive was prepared as follows. Four to six grams of synthetic trans β-carotene was dissolved in 400 mL of toluene with warming. Forty-eight milliliters of jojoba oil was added to the mixture with constant stirring. In a separate container, 20 g of chlorophyll was dissolved in 1000 mL of no. 2 diesel fuel. Thirty milliliters of this solution was then added to the synthetic trans β-carotene/jojoba oil mixture. The synthetic trans β-carotene/jojoba oil/chlorophyll mixture was then diluted to 3785 mL with toluene. Eight to 16 mL of this concentrated solution was added to every gallon of fuel to be treated.

Prior to initiating testing, the engine fuel economy was determined over the course of a 5-year period to be 19.9 miles per gallon (mpg). A smog check was then carried out by a California-certified smog check facility, station no. RG079882. The results were obtained with the engine at idle speed (ca. 850 rpm) and at high speed (ca. 2500 rpm) are shown in Table 10.

TABLE 10

Series of Runs to Establish Baseline Emissions Using Unleaded Gasoline at Idle and at High Speeds

| Parameter | Idle Speed | High Speed |
|---|---|---|
| Hydrocarbons, ppm | 77 | 30 |
| Carbon monoxide, % | 0.44 | 0.59 |
| Carbon dioxide, % | 14.6 | 14.6 |
| Oxygen, % | 0.6 | 0.5 |

Next, in a series of runs, various amounts of additive concentrate per gallon fuel were added to the engine gasoline, and the vehicle was then run under normal conditions until requiring refueling. At that point a subsequent smog check was carried out at the aforementioned smog check facility. The averages of three such consecutive sets of measurements are provided in Tables 11 and 12. The data shown in Table 11 was obtained with the engine at idle speed (ca. 850 rpm), while the data shown in Table 12 was obtained at higher speed (ca. 2500 rpm). The various data obtained with the treated fuels are then shown in comparison with data obtained for neat fuel in Table 13.

TABLE 11

Series of Runs to Establish Reduced Emissions Using Treated Unleaded Gasoline at Idle Speed

| Parameter | Run 1 | Run 2 | Run 3 | Average |
|---|---|---|---|---|
| Hydrocarbons, ppm | 21 | 36 | 31 | 29 |
| Carbon monoxide, % | 0.02 | 0.22 | 0.08 | 0.11 |
| Carbon dioxide, % | 15.9 | 15.6 | 15.7 | 15.7 |
| Oxygen, % | 0.02 | 0 | 0 | 0 |

TABLE 12

Series of Runs to Establish Reduced Emissions Using Treated Unleaded Gasoline at High Speed

| Parameter | Run 1 | Run 2 | Run 3 | Average |
|---|---|---|---|---|
| Hydrocarbons, ppm | 16 | 20 | 21 | 19 |
| Carbon monoxide, % | 0.12 | 0.41 | 0.23 | 0.25 |
| Carbon dioxide, % | 15.8 | 15.6 | 15.7 | 15.7 |
| Oxygen, % | 0 | 0 | 0 | 0 |

TABLE 13

Comparison of Emissions of Neat and Treated Unleaded Gasoline

| Parameter | Idle Speed Neat | Idle Speed Treated | Idle Speed Change, % | High Speed Neat | High Speed Treated | High Speed Change, % |
|---|---|---|---|---|---|---|
| Hydrocarbons, ppm | 77 | 29 | −53 | 30 | 19 | −37 |
| Carbon monoxide, % | 0.44 | 0.11 | −75 | 0.59 | 0.25 | −49 |
| Carbon dioxide, % | 14.6 | 15.7 | 7.5 | 14.6 | 15.7 | 7.5 |
| Oxygen, % | 0.6 | 0 | −100 | 0.5 | 0 | −100 |

The results provided in Tables 10–13 clearly show that the additive has a measurable effect on gasoline emissions. For example, at idle speed, the hydrocarbons emissions were reduced by more than half, while carbon monoxide was diminished by 75%. Similarly, at high speed, hydrocarbons were reduced by 37%, while carbon monoxide emissions were halved.

In separate studies of fuel consumption, three runs with fuel containing additive resulted in fuel economies of 21.2, 20.8 and 20.9 mpg (19.9 mpg for neat fuel), that is, an average increase in fuel efficiency of 5.4%.

The above examples demonstrate that the fuel additive of the present invention provides a substantial improvement in specific fuel consumption in no. 2 diesel fuel. In addition, appreciable decreases of a broad range of volatile organic compounds were observed. Further, carbon monoxide and, to a lesser extent, nitrogen and sulfur oxides, were also found to be reduced. Thus, the additive has the capability of favorably impacting the combustion characteristics of no. 2 diesel fuel.

Having thus described the exemplary embodiments of the present invention, it should be noted by those skilled in the art that the disclosures within are exemplary only, and that various other alternatives, adaptations, and modifications may be made within the scope of the present invention. Accordingly, the present invention is not limited to the specific embodiments as illustrated herein, but is only limited by the following claims.

What is claimed is:

1. A liquid hydrocarbon fuel wherein combustion of said fuel with oxygen produces carbon monoxide and oxides of nitrogen at a given pollutant emission level, wherein the improvement comprises the addition of a fuel additive to said fuel said fuel additive comprising β-carotene consisting essentially of trans β-carotene, chlorophyll, and jojoba oil and being added to said fuel in an amount sufficient to reduce the pollutant emission level of said liquid hydrocarbon fuel.

2. A liquid hydrocarbon fuel according to claim 1 wherein said liquid hydrocarbon fuel is selected from the group of fuels consisting of natural gas, gasoline no. 1 diesel fuel, no. 2 diesel fuel, no. 4 fuel oil, no. 5 light fuel oil, no. 5 heavy fuel oil and no. 6 fuel oil (Bunker C).

3. A liquid hydrocarbon fuel according to claim 1 wherein the amount of fuel additive added to said fuel is sufficient to provide a liquid hydrocarbon fuel containing trans β-carotene, chlorophyll, and jojoba oil in an amount ranging from 0.05 to 10% v/v.

4. A liquid hydrocarbon fuel according to claim 1 wherein said fuel additive further comprises polyethoxylated castor oil surfactants.

5. A liquid hydrocarbon fuel according to claim 4 wherein the amount of fuel additive added to said liquid hydrocarbon fuel is sufficient to provide fuel containing polyethoxylated castor oil surfactants in an amount ranging from 0.05 to 3% v/v.

6. A fuel additive for use in reducing the pollutant emissions produced during combustion of fuel, said fuel additive comprising β-carotene consisting essentially of trans β-carotene, chlorophyll, and jojoba oil wherein the ratio of trans β-carotene to jojoba oil is 8:100 to 20:100 w/v in a solvent carrier and the ratio of chlorophyll to jojoba oil is from 1:100 to 50:100 w/v.

7. A fuel additive according to claim 6 wherein said fuel additive further comprises 20 to 60% v/v polyethoxylated castor oil surfactants.

8. A fuel additive according to claim 6 wherein said solvent carrier is selected from the group of solvents consisting of benzene, xylene, toluene, ethylbenzene, cyclic hydrocarbons, liquid hydrocarbon fuels, halogenated hydrocarbon solvents, liquid aldehydes, alcohols, ketones and water.

9. A method for reducing the level of pollution emissions during combustion of liquid hydrocarbon fuel with oxygen, said method comprising the step of adding a fuel additive to said fuel, said fuel additive comprising β-carotene consisting essentially of trans β-carotene, chlorophyll, and jojoba oil, said fuel additive being added to said liquid hydrocarbon fuel in an amount sufficient to reduce the pollutant emission level of said liquid hydrocarbon fuel.

10. A method according to claim 9 wherein said liquid hydrocarbon fuel is selected from the group of liquid hydrocarbon fuels consisting of natural gas, gasoline, no. 1 diesel fuel, no. 2 diesel fuel, no. 4 fuel oil, no. 5 light fuel oil, no. 5 heavy fuel oil and no. 6 fuel oil (Bunker C).

11. A method according to claim 9 wherein the amount of fuel additive added to said liquid hydrocarbon fuel is sufficient to provide a liquid hydrocarbon fuel containing fuel additive in an amount ranging from 0.05 to 10% v/v.

12. A method according to claim 9 wherein said fuel additive further comprises polyethoxylated castor oil surfactants.

13. A method according to claim 12 wherein the amount of fuel additive added to said liquid hydrocarbon fuel is sufficient to provide liquid hydrocarbon fuel containing polyethoxylated castor oil surfactants in an amount ranging from 0.05 to 3% v/v.

14. A method according to claim 9 wherein said liquid hydrocarbon fuel is diesel fuel and said fuel additive further comprises an alkyl nitrate cetane booster.

15. A method according to claim 14 wherein the amount of fuel additive added to said diesel fuel is sufficient to provide diesel fuel containing an alkyl nitrate cetane booster in an amount ranging from 0.05 to 5% v/v.

16. A method according to claim 12 wherein said liquid hydrocarbon fuel is diesel fuel and said fuel additive further comprises alkyl nitrate cetane boosters.

17. A method according to claim 16 wherein the amount of fuel additive added to said diesel fuel is sufficient to provide diesel fuel containing an alkyl nitrate cetane booster in an amount ranging from 0.05 to 5% v/v.

* * * * *